US005584549A

United States Patent [19]

Lybarger et al.

[11] Patent Number: 5,584,549

[45] Date of Patent: Dec. 17, 1996

[54] FRONT SERVICEABLE APPLIANCE CABINET

[75] Inventors: Michael A. Lybarger, Louisville; Wayne E. Lawson, LaGrange, both of Ky.

[73] Assignee: General Electric Company, Louisville, Ky.

[21] Appl. No.: 429,104

[22] Filed: Apr. 26, 1995

[51] Int. Cl.[6] ..... A47B 47/03

[52] U.S. Cl. ..... 312/265.6; 312/265.5; 312/263; 312/257.1; 220/338; 220/340; 24/293; 24/295; 24/563

[58] Field of Search ..... 312/265.5, 265.6, 312/263, 257.1; 220/338, 340; 24/293, 295, 563

[56] References Cited

U.S. PATENT DOCUMENTS 4,307,588 12/1981 Smith et al. ..... 68/23.7
4,572,596 2/1986 Weir et al. ..... 312/257 R
4,618,193 10/1986 Cuthbert et al. ..... 312/264
4,840,285 6/1989 Carr ..... 220/47
4,988,149 1/1991 Mulder et al. ..... 312/223

*Primary Examiner*—Peter M. Cuomo
*Assistant Examiner*—Stephen Vu
*Attorney, Agent, or Firm*—H. Neil Houser

[57] ABSTRACT

The cabinet for a front serviceable appliance includes a pair of side panels with a lower and an upper support extending between their lower and upper front corners respectively. Tab and slot arrangements mount a front panel on the lower support for pivotal movement between a first position, juxtaposed to the side panels, and a second position, angled away from the side panels. A plurality of locking clips secure a top flange of the front panel to the upper support. A top panel is spaced above the top of the front panel sufficiently for access by a tool to release the front panel from the upper support. Pin and slot arrangements align the front panel with the side panels.

15 Claims, 2 Drawing Sheets

FRONT SERVICEABLE APPLIANCE CABINET

BACKGROUND OF THE INVENTION

The present invention relates to household appliances, such as top loading clothes washing machines for example. Such machines include a cabinet or housing which encloses the various operating components of the machine. When installed, such machines normally are placed with their backs close to a wall and often have very little clearance to their sides. Thus, it is desirable to provide access to the inside of the cabinet through the front, so that any needed repairs or adjustments can be made without removing the machine form its operating position. Thus it is desirable that the front panel of the cabinet be simply and easily removable. There have been a number of efforts to provide such front serviceability; however none have provided optimum front panel removability. For example, in many machines it is necessary to release the machine cover and tilt it upward in order to release the front panel. In other machines it is necessary to tilt the entire machine rearward to release the bottom of the front panel.

It is an object of the present invention to provide an improved cabinet construction for front serviceable appliances.

It is a further object to provide such an improved cabinet construction in which the front panel is securely held in its assembled position while being easily removed without the necessity of removing any other cabinet component or moving the appliance.

SUMMARY OF THE INVENTION

In accordance with one embodiment of the present invention a front serviceable appliance cabinet includes a pair of spaced apart side panels with a lower support extending between their lower edges and an upper support extending between their upper edges. A front panel, sized to span between the side panels, is removably mounted on the lower support for pivotal movement between a first position juxtaposed to the side panels, and a second position, angled away from the side panels. A plurality of recesses are formed in the upper support and a locking clip is mounted to the upper support adjacent each recess. Each clip includes a bight portion spring biased toward the corresponding recess. The front panel includes a top flange with a plurality of slots corresponding to the locking clips so that the bight portions are received in the slots when the front panel is in its first position.

The cabinet also includes a top panel or cover spaced sufficiently above the front panel top flange to permit the insertion of a tool there between to release the bight portions from the slots, so that the front panel can be pivoted away from its first position.

DETAILED DESCRIPTION OF PREFERRED EMBODIMENT

Figures 1, 2:
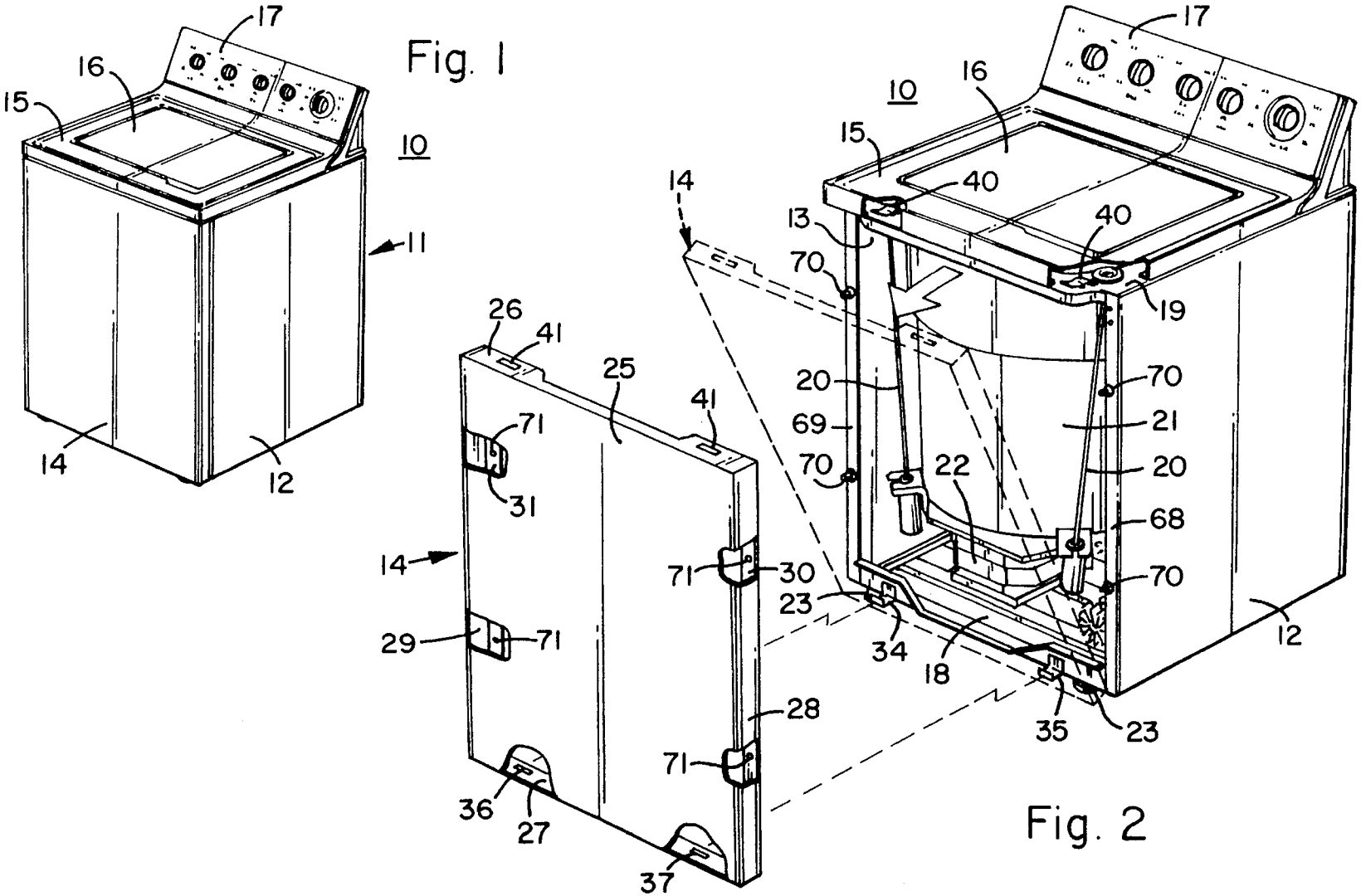
FIG. 1 is a front perspective view of an automatic clothes washing machine of the top loading type.
FIG. 2 is a perspective view of the machine of FIG. 1, with the cabinet front panel shown removed (in solid line) and shown mounted on the lower support in a position angled away from the side panels (in dashed line).
Figure 4:
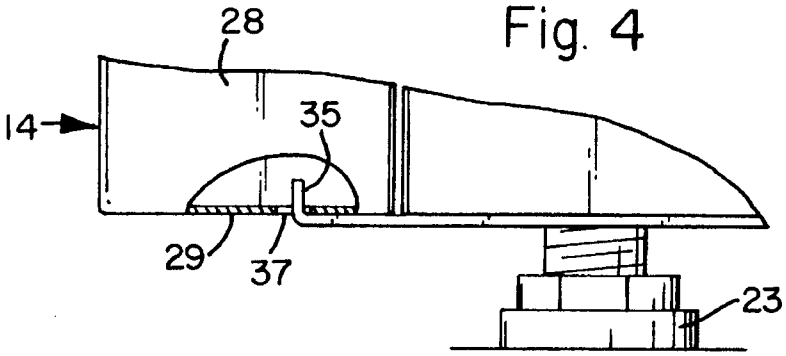
FIG. 4 is a fragmentary side elevation view of the lower front corner area of the machine of FIG. 1, partially broken away for purposes of illustration.

Referring now to FIGS. 1 and 2, There is illustrated a clothes washing machine 10 of the top loading type. The machine includes a cabinet or housing 11 having a box like configuration with lateral walls formed by side panels 12 and 13, a front panel 14 and a rear panel, not shown. The top of the cabinet is closed by a cover or top panel 15. The cover 15 includes a door or lid 16 providing access to the interior of the machine and a control housing or backsplash 17, mounted on the rear of the cover 15. The backsplash 17 encloses various user actuated controls.

The machine includes a lower support 18 and an upper support 19. In the exemplification machine 10, the upper support is in the form of an open rectangular plate. Support rods 20 are mounted adjacent each corner of the plate. Various operating components of the machine, such as the liquid containing tub 21 and motor 22 for example, are supported or suspended from the upper support 19 by the rods 20. The various operating components of the machine 10 form no part of the present invention and many operational washing machine designs are well known. Therefore various operational components have been omitted for the sake of simplicity.

In the exemplification machine 10, the lower support 18 is in the form of a rectangular plate or frame supported on a floor by adjustable feet 23. The side panels 12,13 are mounted on the lower and upper supports 18,19 in spaced apart relationship and the supports 18,19 extend between the lower and upper front corners or edges respectively of the side panels. The top panel or cover 15 is mounted on the upper support 19. The front panel 14 is sized to span between the side panels 12,13 and to extend from just below the cover 15 a position substantially even with the bottom of the side panels. The front panel 14 includes a generally rectangular planar face 25 with a top flange 26, a bottom flange 27 and side flanges 28,29 projecting rearward along the edges of the face 25 to form a continuous flange around the periphery of the face. The side flanges 28, 29 have rear walls 30,31 which project inward from the flanges to overlie the face 25.

The front panel is removably mounted on the lower support 18 for pivotal movement between a first position juxtaposed to the side panels, as seen in FIG. 1 and a second position angled away from the side panels, as shown in dashed line in FIG. 2. To that end the lower support 18 is formed with a pair of tabs 34,35 which are lanced out of the support and project upward in front of the support. The front panel bottom flange 27 is formed with a corresponding pair of slots 36,37 which receive the tabs 34,35 respectively. To mount the panel 14 on the machine 10 the bottom flange 27 is positioned on the lower support 18 with the tabs 34,35 in the slots 36,37, generally as shown in dashed line in FIG. 2. Then the panel 14 is pivoted to bring the top flange 26 toward upper support 19 until front panel 14 is juxtaposed to the side panels 12,13 and its top flange 26 overlaps the upper support 19, as is generally illustrated in FIG. 1. It will be understood that the tabs 34,35 can be lanced from the front panel 14 and the slots formed in the lower support 18. Alternately separate tab members can be mounted on either the panel or support to cooperate with slots formed in the other of the panel and support. However, as the front panel normally is constructed from a thin sheet of metal or plastic and the lower support is constructed from a relatively heavy metal, the illustrated tab and slot arrangement presently is preferred.

Figure 5:
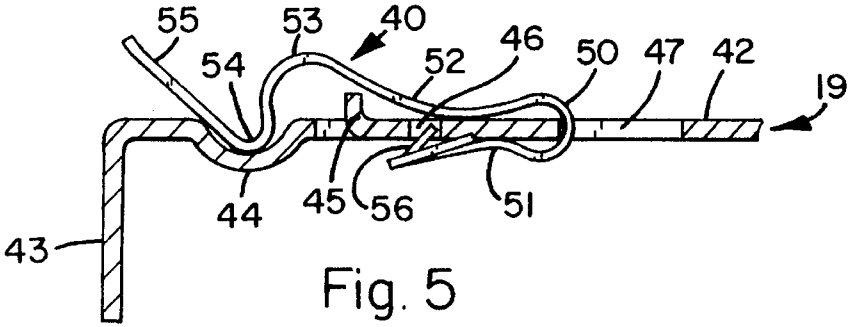
FIG. 5 is a fragmentary cross section view of the upper support of the machine of FIG. 1, illustrating one form of locking clip.

The front panel top flange 26 is secured to the upper support 19 by a clip and slot arrangement. In the exemplification a pair of locking clips 40 are mounted in spaced apart relationship on the upper support. Referring particularly to FIG. 5, one of the clips 40 and its attachment to the support 19 is illustrated. It will be understood that the other clip 40 and its mounting on support 19 are the same. The upper support 19 includes a horizontal plate portion 42 and a downward extending front rim 43. A recess 44 is formed in the plate 42 adjacent to the rim 43. A tang or tab 45 is lanced from the plate portion 42 and projects upward just inside (to the rear of) the recess 44. A relatively small opening 46 is formed in the plate portion just inside the tang 45 and a relatively large opening 47 is formed in the plate slightly inside the smaller opening 46. The recess, tang and openings are in a line front to rear of the support 19. The spring clip 40 includes a return bent base section 50 with a first arm 51 extending forward under the plate portion 42 and a second arm 52 extending forward on top of the plate portion. The arm 52 is formed with an "S" curved portion 53, a bight portion 54 and an up turned tab or finger section 55 at its distal end. The arm 51 includes an upward projecting tang or tab 56. The clip 40 is mounted on the upper support by inserting the first or lower arm 51 through the larger opening 47 and sliding the clip forward until the tang 56 seats in the smaller opening 46. In that position the bight portion is received in recess 44 and is spring biased toward the upper support 19 by the S curved portion 53.

Figure 3:
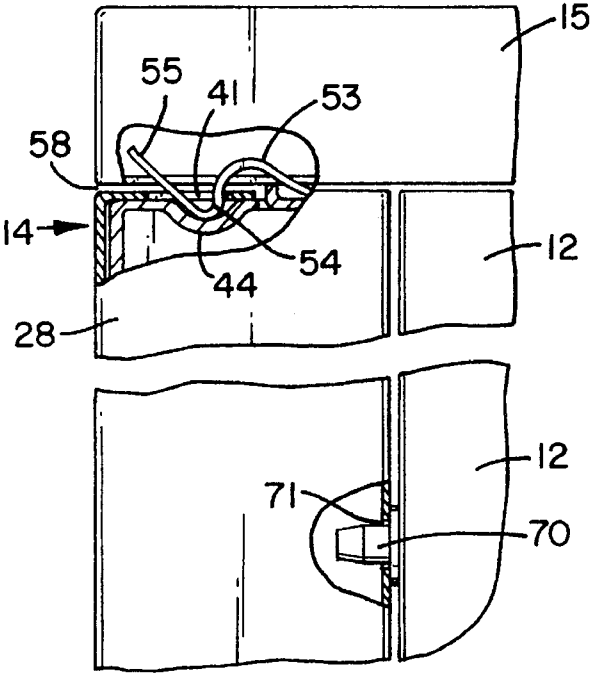
FIG. 3 is a fragmentary side elevation view of the machine of FIG. 1, partially broken away for purposes of illustration.

Referring to FIGS. 2 and 3, the top flange 26 of front panel 14 is formed with a pair of spaced apart slots 41 which are aligned with the clips 40 when the panel 14 is mounted on the machine 10. As the front panel is pivoted to its first position, the leading edge of top flange 26 engages the upturned distal ends 55 of the clips 40 and moves the bight portions 54 upwardly out of recesses 44. As the flange 26 moves rearward, the slots 41 come into alignment with the bight portions 54, which then seat in the slots 41 and recesses 44. The tabs or tangs 45 assure that the front panel will not be pushed to the rear of the machine beyond its first position, with the slots 41 aligned with bight portions 54. The recesses 44 assure that the bight portions 54 are securely received in the slots to secure the top of panel 14 to the upper support 19. It will be understood that the recesses 44 can be in the form of indentations, as shown, or can be in the form of openings in the plate portion 42 of support 19.

Referring to FIG. 3, it will be seen that the cover or top panel 15 is spaced slightly above the top of front panel 14, forming a space 58 there between. The space has a sufficient height that a tool, such as a small screw driver or a putty knife for example, can be inserted into the space and lift the distal ends 55 to free the panel for pivotal movement from its first position toward its second position.

Figure 6:
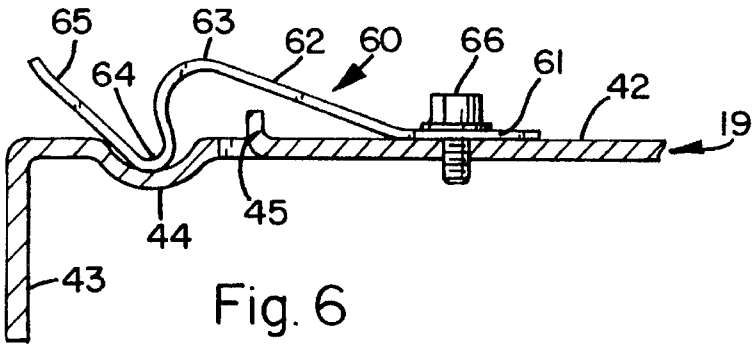
FIG. 6 is a view similar to FIG. 5 but showing another locking clip.

Referring to FIG. 6, there is illustrated another spring clip 60 mounted on the upper support 19. The clip 60 includes a flat base 61 with a single arm 62 extending forward therefrom on top of the support plate portion 42. The arm 62 includes an "S" curved portion 63, a bight portion 64 and an upward projecting tang or finger 65 at its distal end. The clip 60 is mounted on support 19 by a screw or bolt 66 which passes through clip base 61 and is threadedly received in the plate portion 42. The clip 60 cooperates with the front panel 14 in the same manner as described for the clip 41.

It will be understood that the side panels 12,13 and the front panel generally are formed from thin sheet metal, such as thin steel. One result is that the front edge of the side panels are not necessarily perfectly vertical. In addition, the front panel may not be perfectly rectangular. However, it is important that the joint between the front panel and each of the side panels be smooth. Referring to FIG. 2, the side panels 12,13 have front flanges 68,69 respectively, which generally mate with the rear walls 30,31 along the side flanges 28,29 of front panel 14. A pair of pins 70 are mounted on each of the side wall flanges 68,69. Corresponding openings 71 are formed in the rear walls 30,31. As the front panel is pivoted to its first position, juxtaposed to the side panels, the pins 70 are received in the openings 71. This aligns the lateral edges of the front panel with the front edges of the side panels and assures that the joint between them is smooth.

While specific embodiments of the invention have been illustrated and described herein, it is realized that modifications and changes will occur to those skilled in the art to which the invention pertains. It is therefore to be understood that the appended claims are intended to cover all such modifications and changes as fall within the true spirit and scope of the invention.

What is claimed is:

1. A cabinet construction for a front serviceable appliance, comprising:

a pair of spaced apart side panels having upper and lower edges;

a lower support extending between said side panels adjacent said lower edges and an upper support extending between said side panels adjacent said upper edges;

a front panel sized to span between said side panels, said front panel including top, bottom and side flanges extending along a periphery of said front panel;

a plurality of slot and tab pairs interconnecting said front panel bottom flange and said lower support such that said front panel is pivotal between a first position juxtaposed to said side panels and a second position angled away from said side panels;

a plurality of locking clips securing said front panel top flange to said upper support when said front panel is in said first position.

2. A cabinet construction as set forth in claim 1, wherein:

said locking clips are mounted on said upper support and engage said front panel top flange when said front panel is in said first position;

said cabinet construction also includes a top panel mounted over said upper support;

said top panel being spaced sufficiently above said front panel top flange when said front panel is in said first position to permit an insertion of a tool there between to release said front panel from said locking clips for pivotal movement to said second position.

3. A cabinet construction as set forth in claim 1, wherein:

each of said side panels includes a front flange facing said front panel;

each of said front panel side flanges has a rear wall facing one of said side panel front flanges;

a plurality of pins are mounted on selected ones of said side panel front flanges and said front panel rear walls and mating openings are provided on said side panel front flanges and front panel rear walls and interconnect said side panel front flanges and said front panel rear walls when said front panel is in said first position to assure alignment of said front panel side flanges and said side panels.

4. A cabinet construction as set forth in claim 1, wherein:

each of said locking clips is mounted to said upper support and includes a bight portion spring biased toward said upper support member;

said front panel top flange includes a slot therein corresponding to each of said locking clips;

said locking clip bight portions being received in corresponding said slots when said front panel is in said first position.

5. A cabinet construction as set forth in claim 4, wherein:

said bight portions include upward projecting ends adapted to be engaged by a tool to remove said bight portions from said slots in said front panel top flange.

6. A cabinet construction as set forth in claim 4, wherein:

said upper support includes a plurality of tabs positioned relative to said bight portions in order to engage said front panel top flange and limit movement of said front panel away from said second position beyond said first position.

7. A cabinet construction as set forth in claim 4, wherein:

said cabinet construction also includes a top panel mounted over said upper support;

said top panel being spaced sufficiently above said front panel top flange when said front panel is in said first position to permit an insertion of a tool there between to release said locking clip bight portions from said slots in said front panel top flange for pivotal movement of said front panel from said first position.

8. A front serviceable appliance cabinet, comprising:

a pair of spaced apart side panels having upper and lower edges;

a lower support extending between said side panels adjacent said lower edges and an upper support extending between said side panels adjacent said upper edges;

a front panel sized to span between said side panels;

said front panel being removably mounted on said lower support for pivotal movement between a first position juxtaposed to said side panels and a second position angled away from said side panels;

said upper support including a plurality of spaced apart recesses, a plurality of locking clips mounted on said upper support member adjacent said recesses, each of said locking clips including a bight portion spring biased toward a corresponding recess;

said front panel including a top flange extending along its upper periphery, said top flange including a plurality of slots aligned with said locking clips whereby said bight portions are received in corresponding said slots for securing said front panel to said upper support when said front panel is in said first position.

9. A cabinet as set forth in claim 8, wherein:

said bight portions include upward projecting ends adapted to be engaged by a tool to remove said bight portions from said slots in said front panel top flange.

10. A cabinet as set forth in claim 8, wherein:

said upper support includes openings aligned with said recesses; and said locking clips include return bent base portions received in said openings to mount said locking clips to said upper support.

11. A cabinet as set forth in claim 8, further including: threaded fasteners mounting said locking clips to said upper support.

12. A cabinet as set forth in claim 8, wherein:

said upper support includes a plurality of tabs positioned relative to said bight portions in order to engage said front panel top flange and limit movement of said front panel away from said second position beyond said first position.

13. A cabinet as set forth in claim 8, wherein:

said cabinet also includes a top panel mounted over said upper support;

said top panel being spaced sufficiently above said front panel top flange when said front panel is in said first position to permit an insertion of a tool there between to release said locking clip bight portions from said slots in said front panel top flange for pivotal movement of said front panel from said first position.

14. A cabinet construction as set forth in claim 8, wherein:

each of said side panels includes a front flange facing said front panel;

said front panel has a pair of spaced apart side flanges, each of said side flanges has a rear wall facing said side panel front flanges;

a plurality of pins are mounted on said side panel front flanges and said front panel rear walls and mating openings are provided on said side panel front flanges and front panel rear walls and interconnect said side panel front flanges and said front panel rear walls when said front panel is in said first position to assure alignment of said front panel side flanges and said side panels.

15. A front serviceable appliance cabinet as set forth in claim 8, wherein:

said lower support includes a plurality of upward facing tabs;

said front panel includes a bottom flange having a plurality of slots corresponding to said tabs for removably mounting said front panel on said lower support for pivotal movement between said first and second positions.

* * * * *